US006634733B2

(12) United States Patent
Daddey

(10) Patent No.: US 6,634,733 B2
(45) Date of Patent: Oct. 21, 2003

(54) NOZZLE PLATES FOR INK JET PRINTERS AND LIKE DEVICES

(75) Inventor: Ernest O. K. Daddey, Cambridge (GB)

(73) Assignee: Cambridge Display Technology, Cambridge (GB)

( * ) Notice: Subject to any disclaimer, the term of this patent is extended or adjusted under 35 U.S.C. 154(b) by 203 days.

(21) Appl. No.: 09/771,908

(22) Filed: Jan. 29, 2001

(65) Prior Publication Data

US 2001/0033309 A1 Oct. 25, 2001

Related U.S. Application Data

(63) Continuation of application No. PCT/GB99/02794, filed on Aug. 24, 1999.

(30) Foreign Application Priority Data

Aug. 28, 1998 (GB) ..... 9818891

(51) Int. Cl.[7] ..... B41J 2/135
(52) U.S. Cl. ..... 347/45
(58) Field of Search ..... 347/44, 45, 47, 347/46, 55

(56) References Cited

U.S. PATENT DOCUMENTS 4,801,955 A * 1/1989 Miura et al. ..... 347/55
5,208,604 A 5/1993 Watanabe et al. ..... 346/1.1
5,365,255 A * 11/1994 Inoue et al. ..... 347/45
5,548,894 A * 8/1996 Muto ..... 29/890.1
5,646,657 A 7/1997 Aoki ..... 347/45
5,653,901 A 8/1997 Yoshimura ..... 219/121.71
6,109,728 A 8/2000 Kakuda et al. ..... 347/45

FOREIGN PATENT DOCUMENTS

EP 0 540 047 A2 5/1993
EP 0 576 007 A2 12/1993
JP 9-136423 5/1997

OTHER PUBLICATIONS

"Progress and Trends in Ink–Jet Printing Technology", Hue P. Lee, Journal of Imaging Science and Technology, vol. 42, No. 1, Jan./Feb. 1998, pp. 49–62.

International Search Report for PCT/GB99/02794 dated Dec. 23, 1999.

International Preliminary Examination Report for PCT/GB99/02794 dated Nov. 17, 2000.

* cited by examiner

*Primary Examiner*—Anh T. N. Vo
(74) *Attorney, Agent, or Firm*—Marshall, Gerstein & Borun

(57) ABSTRACT

Nozzle plate for a drop on demand printer having a coating formed of fused particles of fluorinated ethylene propylene copolymer. The coating, which offers a low surface energy and good resistance to wear is formed on a laser ablatable material and has an average thickness of at least 200 nm but not greater than 600 nm.

16 Claims, 1 Drawing Sheet

NOZZLE PLATES FOR INK JET PRINTERS AND LIKE DEVICES

This is a continuation of International Application No. PCT/GB99/02794 filed Aug. 24, 1999, the entire disclosure of which is incorporated herein by reference.

BACKGROUND OF THE INVENTION

1. Field of the Invention

This invention relates to nozzle plates for devices such as ink jet printers for ejecting liquids in the form of very small droplets, to a method of making such nozzle plates, and to heads for such devices provided with such nozzle plates.

2. Description of Related Art

In an ink jet printer, ink is ejected in the form of droplets through a small diameter nozzle provided in a printhead on to a receiving surface. If the surface of the printhead surrounding the nozzle becomes wetted with ink, however, the droplets tend to be diverted from the correct direction of travel or, in extreme cases, cannot be ejected at all.

To overcome this problem, it has been proposed to provide a nozzle plate comprising a plate provided with one or more nozzle holes and having an ink-repellant layer, usually formed of a fluorinated or silicone compound, coated on the surface of the plate having the nozzle hole outlet(s). The object of the layer is to prevent that surface of the plate being wetted by the ink or at least to reduce the tendency of that surface to be wetted by the ink, so that the time before having to clear or replace the nozzle plate is extended. The plate comprises a plate blank which is generally formed of polysulphone or polyimide or other laser-ablatable material, and after the application of the ink-repellant layer to one face thereof, the nozzle hole is formed by exposing the thus-coated blank to a laser beam preferably an excimer laser beam, of appropriate diameter. The nozzle plate so formed, complete with nozzle hole or holes, is then bonded to the body of the printhead with the or each nozzle hole of the plate aligned with a respective ink channel formed in the body.

A range of low surface energy materials has been proposed for the ink-repellent layer but because of its advantageous combination of low surface energy and resistance to wear, this application is particularly concerned with the use of fluorinated ethylene propylene copolymer (FEP) for this purpose. It is believed that the desirable wear-resistance of this copolymer is due at least in part to its crystallinity, and in this respect it differs substantially from most other fluorine-based compounds that have been proposed because whereas coatings from the latter are readily obtained from solution, eg. as described in EP-A-0,576,007, FEP is insoluble or substantially so in most solvents and therefore has to be applied as a dispersion of polymer particles. FEP coatings thus differ in kind from those derived from solution.

The coating of ink jet printhead nozzle plates with FEP has already been proposed in U.S. Pat. No. 5,646,657 and U.S. Pat. No. 5,653,901. U.S. Pat. No. 5,646,657 proposes including a u.v. absorber m the fluid coating mixture to improve the roundness of the hole formed in the coating layer by the excimer laser. We have found, however, that inclusion of the u.v. absorber can reduce the ink-repellency of the layer. U.S. Pat. No. 5,653,901 proposes heat treating the layer so as to soften and flatten burrs in the layer formed in the nozzle-hole forming process.

U.S. Pat. No. 5,208,604 discloses a method of manufacturing an orifice plate comprising the steps of applying a liquid repellant, curing the coating using UV-ray irradiation and forming orifices by using an excimer laser.

The publications U.S. Pat. No. 5,646,657 and U.S. Pat. No. 5,653,901 both describe forming the nozzle hole in the nozzle plate blank by exposing the back surface of the blank (ie. the uncoated surface) to an excimer laser beam and both recommend an FEP layer thickness of about 1 $\mu$m (1000 mn). However, we have found it preferable to form the nozzle hole by exposing the front surface of the plate (ie. the coated surface) of the blank to the laser beam. A reason for this is that the shape and quality of the outlet end of the nozzle hole is important for the correct direction of travel of the ink droplets and by exposing the coated surface of the blank to the laser, it is possible to ensure that the face of the plate in which the outlet is to be formed is in the focal plane of a laser beam focussing system.

With this procedure, however, it will be apparent that the mechanism by which the hole is formed in the FEP layer will be different from that of the procedure in which the laser beam is directed initially on to the back of the blank. In the latter case, the hole in the plate is formed, in effect, by explosion of the laser-ablatable material of the blank that is exposed to the laser beam and the hole is subsequently extended forward through the FEP layer in the direction of the laser beam by vaporisation of the layer as a result of the heat and kinetic energy released by the action of the laser on the material of the blank. In the former case, on the other hand, the direction of the laser beam and the direction of formation of the hole in the FEP layer, which is believed to be by the same mechanism of vaporisation since FEP is itself generally transparent to lasers, are opposed. In any event, we have found that when forming the nozzle hole by directing the laser beam at the coated face of the plate and the coating comprises fused FEP particles, general guidelines for operation where the laser beam is directed at the back (uncoated) face of the blank do not apply; in particular it is not possible to obtain nozzle outlet holes of acceptable quality at the recommended layer thicknesses of about 1 $\mu$m, particularly at preferred nozzle sizes of 50 $\mu$m and below.

SUMMARY OF THE INVENTION

We have now found that when directing the laser beam at the coated face of the plate, the consistent production of nozzle hole outlets of acceptable quality is dependent on the thickness of the FEP layer being within a critical range which is substantially below 1000 nm, especially at the smaller nozzle hole sizes such as 50 $\mu$m and below.

Thus, according to the present invention, there is provided a method of forming an ink jet printer nozzle plate, said method comprising providing a nozzle plate blank comprising laser-ablatable material, said blank having on one face thereof an ink repellent layer comprising fused solid particles of fluorinated ethylene propylene copolymer (FEP), said layer being at least 200 nm but not greater than 600 nm average thickness, and forming a nozzle hole or holes in said coated blank by exposing the coated face of said blank to a laser beam.

While the process of ablation by excimer laser is to be preferred, the present invention is not intended to be restricted to this type of high energy beam. Radiation from other types of laser sources may be employed as a high energy beam.

In a preferred embodiment, the coated blank is bonded to the printhead prior to forming the nozzle hole or holes, to enable each nozzle hole to be formed in direct alignment with a corresponding channel in the printhead. However, formation of the or each nozzle hole prior to bonding the blank to the printhead is not found to affect the functional quality of the nozzles.

The invention also provides a nozzle plate blank suitable for use in the invention, and comprises laser-ablatable material, said blank having on one face thereof an ink repellent layer comprising fused solid particles of fluorinated ethylene propylene copolymer (FEP), said layer being at least 200 nm but not greater than 600 nm average thickness.

Very good results have been obtained consistently at layer thicknesses in the range of about 200 nm to 300 nm.

BRIEF DESCRIPTION OF THE DRAWINGS

The invention will now be described in greater detail with reference to preferred embodiments thereof and with the aid of the accompanying drawings in which.

DETAILED DESCRIPTION

Figure 1:
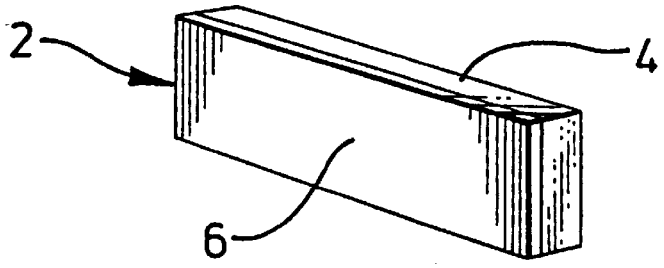
FIG. 1 depicts, in much enlarged form, a coated nozzle plate blank in accordance with the invention.

Referring first to FIG. 1, the nozzle plate blank 2 comprises a blank 4 having on one face thereof an ink-repellent layer 6 of fused solid FEP particles.

The nozzle plate blank 2 may be formed of any suitable laser-ablatable material. Generally, it will comprise a plastics material and may be formed from such material by any suitable method e.g. moulding, extrusion or casting. The material should be of sufficiently high melting point to withstand the temperatures required to fuse the FEP particles, eg 300° C. or higher for the time it takes to achieve the desired surface quality. Non-exclusive examples of suitable plastics materials are polyimide, polysulphone, polyethersulphone and polyetheretherketones (PEEK).

The ink repellant layer 6 is preferably provided by applying a dispersion of FEP to one face of the blank and thereafter heating first to evaporate the liquid vehicle and subsequently to fuse the FEP particles. The heatings can be performed in one step but this is not preferred.

The particles may be dispersed in any suitable liquid to form the dispersion. The liquid may be organic or inorganic or a mixture. It is preferable to use a single phase mixture of solvents to achieve the required surface quality. Ethanol and/or water are examples of suitable solvents, preferably ethanol.

The dispersion may include a dispersant to assist in stabilisation of the dispersion. Any suitable dispersant may be used provided it does not interfere unacceptably with the formations of the layer from the dispersion, the bonding of the layer to the blank or the ink-repellant properties of the layer.

Surfactants and/or wetting agent may also be provided in the dispersion in order to improve the finished surface quality of the nozzle plate.

The average particle size of the particles employed to form the dispersion is preferably in the range of about 50 to 250 nm, such as 100 to 250 nm. Preferably the particles are substantially uniform in size, eg. ±100 nm or less of the average particle size. The average particle size is more preferably in the range 150 to 200 nm.

Any suitable procedure may be employed for applying the dispersion to the face of the blank provided that the layer obtained from it after removal of the liquid vehicle and fusion of the particles is from 200 to 600 nm in average thickness and of relatively uniform thickness. Suitable methods are for example bar coating, spray coating, dip or spin coating. By "relatively uniform" is meant that the thickness of the layer over the area of the blank does not vary by more than about 50 nm, and preferably not more than 20 nm, from the average thickness; however, preferably no part of the layer should be more than 600 nm or less than 200 nm. Preferably, the thickness of the layer does not vary by more than about 10% of the average thickness.

If desired, the face of the blank may be treated prior to application of the dispersion to improve the bonding of the layer to the face. Examples of suitable treatments are plasma etchings, corona treatment, chemical etching, application of a primer, and coating with a chemical adhesion promoter.

After application of the dispersion, the coating so formed is treated to remove the liquid vehicle, eg., by heating to evaporate the vehicle, and is heated to fuse the particles to form the desired layer. The ink-repellant properties of the layer appear to be controlled at least to some extent by the temperature and time chosen for the heating step to achieve fusion and the optimum conditions may readily be established by experiment.

If the average thickness of the layer 6 is less than 200 nm, its ink-repellant characteristics tend to be non-uniform or otherwise imperfect. At an average thickness above 600 nm, however, the quality of the nozzles formed in the plate tends to deteriorate; for example, the edges of the nozzle outlet tend to become rough and/or non-circular. The average thickness may be calculated, for example, from knowledge of the density of the FEP and the weight of the plate blank before and after formation of the layer.

Figure 2A:
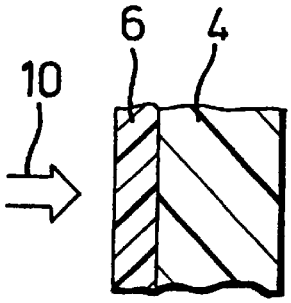
FIGS. 2A to 2C depict in more enlarged form the stages of forming the nozzle plate.
Figure 2B:
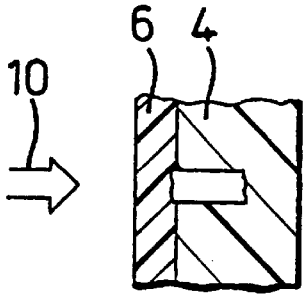
Figure 2C:
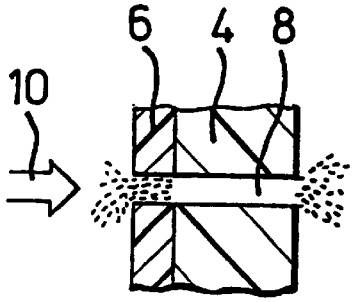

Referring now to FIG. 2, the nozzle hole or holes 8 are formed in the nozzle plate by directing at the face of the plate carrying the layer 6, an excimer laser beam 10 (FIG. 2A) chosen for its ability to ablate the material of the plate blank, and of a diameter chosen to form in the plate a nozzle hole of the desired diameter. As the layer 6 is substantially transparent to excimer laser light having a wavelength in the u.v. range, it is believed that the beam is absorbed substantially by the material of the blank, leading to disintegration and decomposition of the molecules and scattering of the atoms (FIG. 2B), and formation of the desired hole therein, and that the material of the coating layer overlying the hole is decomposed by the energy of the said decomposed molecules and scattered atoms thereby completing the formation of the hole through the coated blank (FIG. 2C). In any event, by exposing the coated blank to an excimer laser beam as described, holes of acceptable shape are readily formed in the coated blank, even at diameters as low as 50 $\mu$m or lower, eg. 25 $\mu$m or lower. This is of considerable value as the size of the nozzle has a direct influence on the size of the droplet that can be ejected. Smaller nozzles are therefore capable of ejecting smaller droplets and thus are capable of producing images with greater dot definition and image quality.

Figure 3:
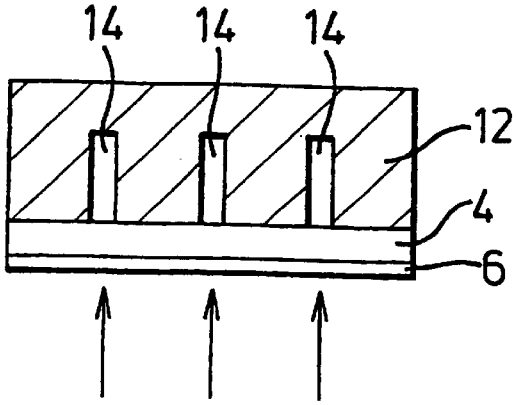
FIG. 3 is a diagrammatic cross-sectional plan view of the application of a laser beam to form the holes in the nozzle plate after the bonding of the same to an ink-jet printer printhead.

In one embodiment, illustrated in FIG. 3, after the formation of the ink-repellant layer 6 thereon, the nozzle plate blank 4 is bonded to an ink jet printhead 12 prior to exposure to the excimer laser beam to form the holes therein, thereby permitting accurate alignment of the laser beam 10 with the ink channel 14 in the printhead into which the hole is to open. The manner in which the plate is bonded to the printhead does not form part of the invention and any suitable method may be used. Alignment may be assisted, for example, by projecting through the channel 14 a beam of radiation which can be detected on the outside of the coated nozzle plate. Where the coated nozzle plate is translucent, this may conveniently be a beam of visible light.

EXAMPLE

A series of coated nozzle blanks were prepared with FEP layers of different thickness by the application of an aqueous dispersion of FEP and subsequent heating of the dispersion to evaporate the water and fuse the particles. The ink-repellant properties of the coated blanks were determined by measuring the Receeding Meniscus Velocity (RMV) as described in WO97/15633 and by measuring the wetting co-efficient using propylene carbonate as the solvent. The results are tabulated below:

| Example | Coating Thickness $\mu$m | RMV mm/sec | Wetting Co-efficient |
|---|---|---|---|
| 1 | 0.1 | 16.0 | 0.30 |
| | 0.1 | 16.0 | 0.37 |
| 2 | 0.2 | 14.3 | 0.20 |
| | 0.2 | 14.3 | 0.28 |
| 3 | 0.3 | 18.2 | 0.18 |
| | 0.3 | 18.2 | 0.28 |
| 4 | 0.5 | 14.8 | 0.21 |
| | 0.5 | 14.8 | 0.20 |
| 5 | 0.7 | 13.8 | 0.27 |
| | 0.7 | 13.8 | 0.25 |
| 6 | 1 | 15.6 | 0.28 |
| | 1 | 15.6 | 0.28 |

The values for RMV are generally acceptable over the entire range of layer thickness but while the wetting co-efficient is acceptable in the range 200 to 500 nm, it is unacceptably high at 100 nm and at 700 nm and above.

Nozzle plates were formed from the coated blanks by drilling 50 $\mu$m diameter holes in the coated blanks by firing an excimer laser beam at the coated face of the blank. The nozzles were of good roundness and regularity in cross-section.

While the invention has been described above with specific reference to ink jet printers, it may be applied more broadly to any device which, like an ink jet printer, is for the ejection of a liquid in the form of very small droplets through a small nozzle and where a liquid repellant coating is required on the nozzle plate. Examples of such liquids are varnishes, solvents, medical fluids and the like.

What is claimed is:

1. A nozzle plate blank for a device for ejecting a liquid in a form of droplets through a nozzle, said blank comprising laser-ablatable material, and said blank having on one face thereof a liquid-repellant layer comprising fused solid particles of fluorinated ethylene propylene copolymer (FEP), said layer being at least 200 nm but not greater than 600 nm average thickness.

2. A nozzle plate blank as claimed in claim 1 wherein the particles have an average particle size in the range 100 nm to 250 nm prior to fusion.

3. A nozzle plate blank as claimed in claim 2 wherein the average particle size is 150 nm to 200 nm prior to fusion.

4. A nozzle plate blank as claimed in claim 1 wherein the particles are of substantially uniform size prior to fusion.

5. A nozzle plate blank as claimed in claim 1 wherein the thickness of the layer does not vary by more than 10% of the average thickness.

6. A nozzle plate blank as claimed in claim 1 wherein no part of the layer is more than 600 nm thick or less than 200 nm thick.

7. A nozzle plate blank as claimed in claim 1 for an ink jet printer.

8. A method of forming a nozzle plate for a device for ejecting a liquid in a form of droplets through a nozzle, said method comprising steps of:

providing a nozzle plate blank comprising laser-ablatable material, said blank having on one face thereof a liquid-repellant layer comprising fused solid particles of fluorinated ethylene propylene copolymer (FEP), said layer being at least 200 nm but not greater than 600 nm average thickness, and forming a nozzle hole or holes in said coated blank by exposing the coated face of said blank to a laser beam.

9. A method as claimed in claim 8 wherein the particles have an average particle size in the range 100 nm to 250 nm prior to fusion.

10. A method as claimed in claim 9 wherein the nozzle hole or holes is or are not greater than 50 $\mu$m in diameter.

11. A method as claimed in claim 8 wherein the device is an ink jet printer.

12. A method as claimed in claim 11 wherein the coated blank is bonded to an ink jet printhead prior to forming the nozzle hole or holes.

13. A method as claimed in claim 8 wherein the average particle size is 150 to 200 nm prior to fusion.

14. A method as claimed in claim 8 wherein the particles are of substantially uniform size prior to fusion.

15. A method as claimed in claim 8 wherein the thickness of the layer does not vary by more than 10% of the average thickness.

16. A method as claimed in claim 8 wherein no part of the layer is more than 600 nm thick or less than 200 nm thick.

* * * * *

UNITED STATES PATENT AND TRADEMARK OFFICE

CERTIFICATE OF CORRECTION

PATENT NO. : 6,634,733 B2
DATED : October 21, 2003
INVENTOR(S) : Daddey

It is certified that error appears in the above-identified patent and that said Letters Patent is hereby corrected as shown below:

Title page,
Item [73], Assignee, please change "Cambridge Display Technology, Cambridge (GB)" to -- Xaar Technology Limited, Cambridge (UK) --.

Signed and Sealed this

Eighteenth Day of May, 2004

JON W. DUDAS
*Acting Director of the United States Patent and Trademark Office*